US005885144A

United States Patent [19]

Martin et al.

[11] Patent Number: 5,885,144

[45] Date of Patent: Mar. 23, 1999

[54] SANDING APPARATUS

[75] Inventors: Michael Martin, Darlington; Eric Cockburn, Durham, both of United Kingdom

[73] Assignee: Black & Decker Inc., Newark, Del.

[21] Appl. No.: 726,844

[22] Filed: Oct. 3, 1996

[30] Foreign Application Priority Data

Oct. 4, 1995 [GB] United Kingdom ..... 9520254

[51] Int. Cl.[6] ..... B24B 23/00

[52] U.S. Cl. ..... 451/356; 451/359; 451/357

[58] Field of Search ..... 451/350, 351, 451/353, 354, 356, 357, 359

[56] References Cited

U.S. PATENT DOCUMENTS

| | | | |
|---|---|---|---|
| 2,358,861 | 9/1944 | Koether . | |
| 4,459,782 | 7/1984 | Palmer . | |
| 4,893,436 | 1/1990 | Rich | 451/356 |
| 4,920,702 | 5/1990 | Kloss et al. . | |
| 5,123,216 | 6/1992 | Kloss et al. . | |
| 5,398,457 | 3/1995 | Updegrave et al. | 451/356 |
| 5,491,896 | 2/1996 | Stolzer et al. . | |
| 5,527,212 | 6/1996 | Bowen et al. | 451/356 |
| 5,554,066 | 9/1996 | Boston et al. | 451/356 |
| 5,558,569 | 9/1996 | Lee | 451/356 |

FOREIGN PATENT DOCUMENTS

| | | |
|---|---|---|
| 0699505 | 3/1996 | European Pat. Off. . |
| 4444028 | 6/1995 | Germany . |
| 8702924 | 5/1987 | WIPO . |

*Primary Examiner*—Eileen P. Morgan
*Attorney, Agent, or Firm*—Bruce S. Shapiro; Dennis A. Dearing; John D. Del Ponti

[57] ABSTRACT

A sanding apparatus (1) is provided with a platen (2) formed of several layers and with a flat surface to which an abrasive sheet is attached. The platen (2) has a peripheral edge (7) with at least one point (4). A conductive means (18, 20) is provided through the layers of the platen (2) to act as a heat sink adjacent to the point (4) to remove heat from the surface point (4).

8 Claims, 1 Drawing Sheet

SANDING APPARATUS

This invention relates to a sanding apparatus, particularly a sanding apparatus with at least one detail sanding point.

Sanding apparatus are known which have platens to which abrasive sanding sheets are attached. Orbital or random motion is applied to the platen by a motor via a central drive. The platen moves in relation to a head of the apparatus.

Platens can be of varying shapes, known examples include circular and rectangular platens. Platens for detailed sanding are generally triangular in shape with outwardly curved edges and three detailed points. Iron shaped platens are also known in which a single point is provided for detailed sanding whilst a large surface is provided for general sanding.

Known sanding apparatus have a body of the platen of a hard plastics material to which a carrier layer is mechanically lockable. The carrier layer bears a Velcro (registered trade mark) connection to which a foam pad, also bearing a Velcro connection is applied. The abrasive sheet can be applied to the surface of the foam pad also by means of a Velcro attachment. The term platen is used herein to denote the combination of the platen body, the foam pad and any intermediate layer.

The points of the foam pads of detail sanding platens often become heated due to extensive use of the point by angling the platen such that only the point of the foam pad is in contact with the surface being sanded.

According to the present invention there is provided a sanding apparatus comprising a platen with a flat surface to which an abrasive sheet can be attached, the platen having a peripheral edge with at least one point, wherein a conductive means is provided through the platen which acts as a heat sink adjacent the point removing heat from the surface.

Preferably, the conductive means is a metal bolt. The metal bolt is flush with the surface of the platen to which an abrasive sheet is attached.

Preferably, the metal bolt attaches the separate layers of the platen together.

The separate layers of the platen may comprise a hard plastics material platen body, a carrier layer and a foam pad layer. The foam pad layer provides the surface to which the abrasive sheet is attached.

Preferably, the abrasive sheet is attached to the surface of the platen by means of a Velcro attachment.

The portion of the platen adjacent to the point may be detachable.

Embodiments of the present invention are now described, by means of example only, with reference to the accompanying drawings in which.

Figure 1:
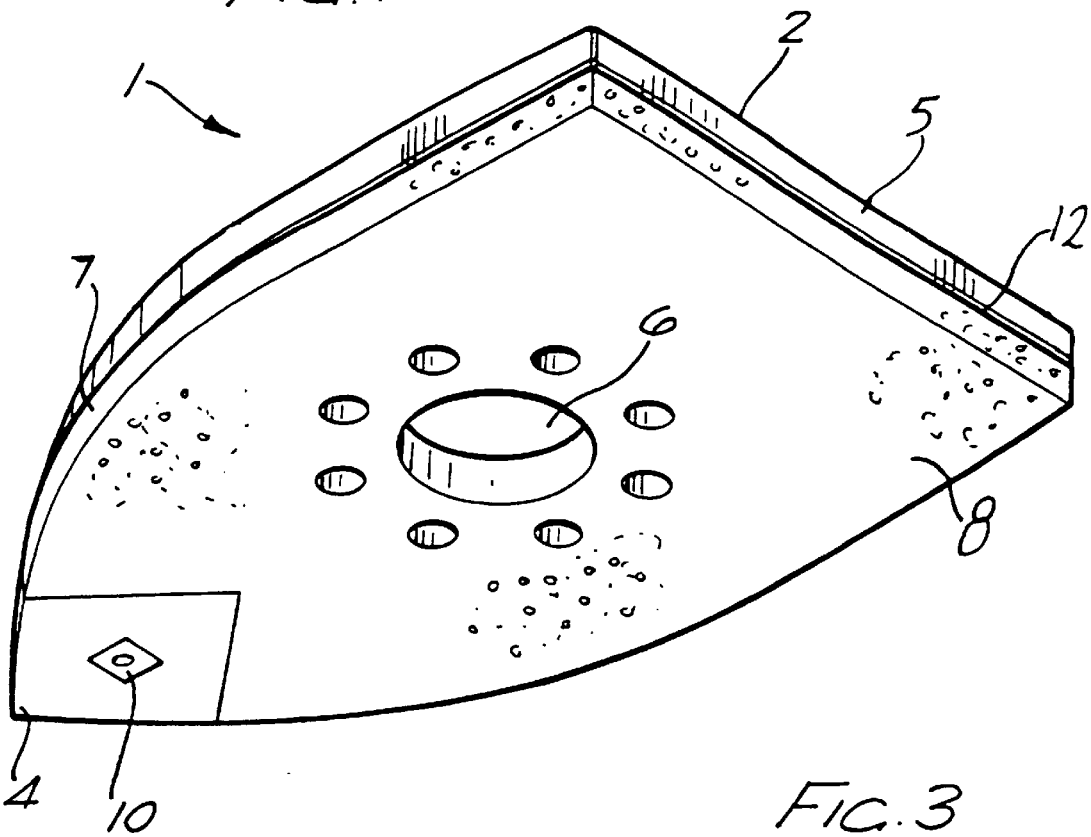
FIG. 1 is a perspective view of a first embodiment of a sanding apparatus in accordance with the present invention.

Referring to the drawings, a sanding apparatus 1 has a platen 2 formed by the layers of the platen body 5, a carrier layer 12 and a foam pad layer 8.

Figure 2:
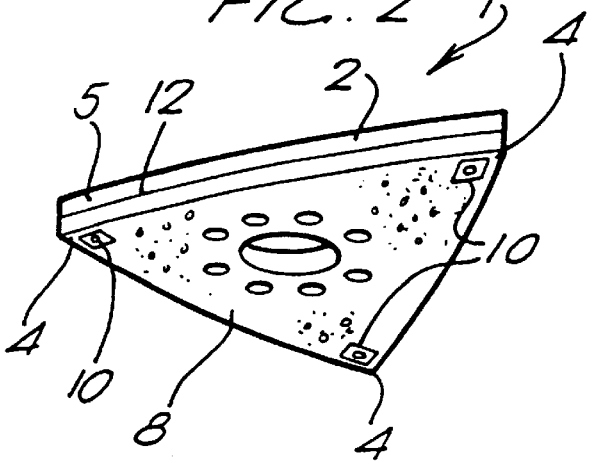
FIG. 2 is a perspective view of a second embodiment of a sanding apparatus in accordance with the present invention.
Figure 3:
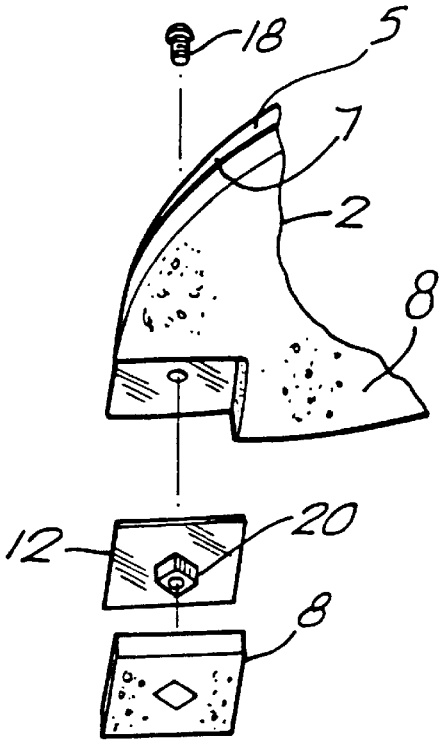
FIG. 3 is an exploded detail of the sanding apparatus of FIG. 1 or FIG. 2.

The platen 2 has a peripheral edge 7 which has at least one point 4. FIG. 1 shows a platen 2 with a single detail point 4. FIG. 2 shows a platen 2 of a detail sanding apparatus with three points 4.

Motion is applied to the platen 2 by a motor through a central drive 6. The platen 2 moves in reaction to a head of the apparatus 1.

In known sanding apparatus, the carrier layer 12 is mechanically attached to the platen body 5. The carrier layer 12 bears a Velcro connection. The foam pad layer 8 also bears a corresponding Velcro connection such that the foam pad layer 8 is held on the carrier layer 12 by the Velcro connection. The foam pad layer 8 also carries a Velcro connection on the surface to which an abrasive sheet is attachable. The Velcro surface of the foam pad layer 8 can become worn by the heat generated by the sanding action.

In the presently described embodiments, a bolt 18 is provided through the platen 2 including the foam pad layer 8. A nut 20 secures the bolt 18. The nut 20 lies flush with the surface of the foam pad layer 8. The nut 20 and bolt 18 are formed of a conductive material such as metal. The nut 20 and bolt 18 act as a heat sink conducting the heat away from the surface of the foam pad layer 8 at the point 4. The heat can be dissipated throughout the sanding apparatus 1.

In addition, the nut 20 and bolt 18 provide a securement through the layers of the platen 2 removing the need for a Velcro attachment between the carrier layer 12 and the foam pad layer 8. This is advantageous as during sanding, the connection can be inhibited by dust clogging the Velcro connection.

The abrasive sheet can be applied by the Velcro attachment means on the surface of the foam pad layer 8 over the flush surface of the nut 20.

The area surrounding the point 4 of the foam pad layer 8 can be detachable from the remainder of the platen 2.

Modifications and improvements can be made to the above without departing from the scope of the present invention.

We claim:

1. A sanding apparatus comprising a platen with a flat surface to which an abrasive sheet can be attached, the platen having a peripheral edge with at least one point, wherein a conductive means is provided through the platen with portions of the means being substantially flush with the flat surface and which acts as a heat sink adjacent the point removing heat from the surface.

2. A sanding apparatus as claimed in claim 1, wherein the conductive means is a metal bolt.

3. A sanding apparatus as claimed in claim 2, wherein portions of the metal bolt are flush with the surface of the platen to which the abrasive sheet is attached.

4. A sanding apparatus as claimed in claim 2, wherein the metal bolt attaches separate layers of the platen together.

5. A sanding apparatus as claimed in claim 4, wherein the separate layers of the platen comprise a hard plastics material platen body, a carrier layer and a foam pad layer.

6. A sanding apparatus as claimed in claim 5, wherein the foam pad layer provides the surface to which the abrasive sheet is attached.

7. A sanding apparatus as claimed in claim 1, wherein the abrasive sheet is attached to the surface of the platen by means of a Velcro attachment.

8. A sanding apparatus as claimed in claim 1, wherein a portion of the platen adjacent the point is detachable.

* * * * *